US007367275B2

(12) United States Patent
Tajima

(10) Patent No.: US 7,367,275 B2
(45) Date of Patent: May 6, 2008

(54) SEWING MACHINE FRAME AND METHOD FOR ASSEMBLING THE SAME

(75) Inventor: Ikuo Tajima, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 21 days.

(21) Appl. No.: 10/566,908

(22) PCT Filed: Aug. 20, 2004

(86) PCT No.: PCT/JP2004/011159

§ 371 (c)(1),
(2), (4) Date: Feb. 3, 2006

(87) PCT Pub. No.: WO2005/012621

PCT Pub. Date: Feb. 10, 2005

(65) Prior Publication Data

US 2007/0101915 A1 May 10, 2007

(30) Foreign Application Priority Data

Aug. 5, 2003 (JP) ..... 2003-286631

(51) Int. Cl.
*D05B 75/00* (2006.01)
*D05B 69/00* (2006.01)

(52) U.S. Cl. ..... 112/258

(58) Field of Classification Search ..... 112/258, 112/259, 260, 217.1–217.3, 103, 102, 117, 112/470.12, 470.18
See application file for complete search history.

(56) References Cited

U.S. PATENT DOCUMENTS 2,183,366 A * 12/1939 Chason et al. ..... 112/217.2
4,429,650 A * 2/1984 Ishikawa et al. ..... 112/258
4,669,405 A * 6/1987 Resta et al. ..... 112/470.12
5,103,747 A * 4/1992 Resta et al. ..... 112/117
5,249,537 A * 10/1993 Sakakibara ..... 112/103
5,287,820 A * 2/1994 Stutznacker ..... 112/117
5,706,747 A * 1/1998 Tajima et al. ..... 112/258
5,809,918 A * 9/1998 Tajima et al. ..... 112/103
6,325,008 B1 * 12/2001 Aikyo ..... 112/470.18

FOREIGN PATENT DOCUMENTS

JP 63-83179 U 6/1988
JP 6-207365 A 7/1994
JP 9-94367 A 4/1997
JP 2000-245986 A 9/2000

* cited by examiner

*Primary Examiner*—Ismael Izaguirre
(74) *Attorney, Agent, or Firm*—Rossi, Kimms & McDowell LLP

(57) ABSTRACT

A sewing machine main frame includes an upper support member, and a lower support member positioned in substantially parallel relation to the upper support member with a predetermined interval therebetween and integrally joined with each other via a joint member. A supporting leg section is attached to a predetermined position of the main frame to support the main frame in a substantially horizontal orientation at a predetermined height. The main frame and supporting leg section are provided as separate component parts. Because the main frame is constructed of the upper and lower support members integrally joined via the joint member, the main frame and the supporting leg section can be transported to a predetermined assembling place before the supporting leg section is attached to the main frame.

16 Claims, 8 Drawing Sheets

SEWING MACHINE FRAME AND METHOD FOR ASSEMBLING THE SAME

This is a U.S. National Phase Application of PCT International Application PCT/JP2004/011159 filed on Aug. 4, 2004.

TECHNICAL FIELD

The present invention relates generally to sewing machine frames of multi-head sewing machines. More particularly, the present invention relates to a structure of a sewing machine frame having superior transportability and capable of being readily assembled after transport, as well as an assembly method therefor.

BACKGROUND ART

Among the various conventionally-known machine frames employed in multi-head sewing machines provided with a plurality of machine heads is a type disclosed, for example, in Japanese Patent Application Laid-open Publication No. HEI-9-94367. As shown in FIGS. 12 and 13, the disclosed sewing machine frame includes a pair of bases 20 opposed to each other, in a left-and-right direction (i.e., direction of arrow X), with a predetermined spacing interposed therebetween, and a pair of vertical supporting posts 21 fixed to the supper surfaces of the bases 20. Upper and lower frames 22 and 23 connect between and are fixed at opposite ends to the supporting posts 21; the upper frame 22 formed of a high-rigidity material, such as a rectangular steel pipe, is provided for mounting thereon machine heads (not shown) that drive sewing needles, while the lower frame 23 formed of a rectangular steel pipe or the like is provided for mounting thereon hook bases (not shown) each having a built-in rotary hook rotationally driven beneath the upper frame 22 in synchronism with up-and-down movement of a corresponding sewing needle. Auxiliary supporting posts 24 are fixed to the respective back surfaces of the two supporting posts 21, so as to strengthen joints between the bases 20 and the supporting posts 21 and between the supporting posts 21 and the upper frame 22.

The aforementioned sewing machine frame is assembled with respective fixed portions of its individual component parts welded together. Briefing a method for assembling and processing the conventionally-known sewing machine frame, a pair of leg sections A are formed by welding the supporting posts 21 and auxiliary supporting posts 24 to the bases 20, as illustrated in FIG. 13. Then, the upper frame 22 is placed on and welded to the upper end surfaces (indicated at A1 in the figure) of the thus-formed leg sections A, and the lower frame 23 is welded at its opposite end portions to respective vertically-intermediate portions (indicated at A2 in the figure) of the supporting posts 21. In this way, the upper and lower frames 22 and 23 connect between and are fixed at its opposite ends to the pair of leg sections A each comprising the base 20, supporting post 21 and auxiliary supporting post 24; namely, the sewing machine frame is assembled with the individual component parts integrally fixed together.

Such a sewing machine frame is pre-assembled as an integral unit, in a welding plant or the like, in the manner as described above. The thus pre-assembled sewing machine frame is transported to a machine assembling plant. In the machine assembling plant, other necessary component parts, such as machine heads, are assembled or attached to the transported sewing machine frame to ultimately complete a multi-head sewing machine. However, because the conventional sewing machine frames are each pre-assembled as an integral unit, many such pre-assembled sewing machine frames can not be transported at a time from the welding plant to the assembling plant, which undesirably results in a poor transport efficiency and hence an increase in the cost for transporting the sewing machine frames. Particularly, in cases where assembled sewing machine frames are transported to or from abroad, the aforementioned inconveniences would become prominent due to a packaging problem. As one approach to solve such problems, it is conceivable to separately pack the pair of leg sections A, upper frame 22 and lower frame 23 of each sewing machine frame and transport the separately-packed component parts to the machine assembling plant where the component parts are welded together to assemble the sewing machine frame. However, with the conventional sewing machine frame, the upper frame 22 and lower frame 23 have to be welded to different predetermined portions of the pair of leg sections A, which would require a long time. Besides, it is very difficult to weld the lower frame 23 accurately to the predetermined portions A2 of the leg sections A. Because of these, sewing machine frames can not be assembled appropriately in the machine assembling plant. Therefore, the above-mentioned approach can not be used appropriately, and, after all, there was no other choice but to transport sewing machine frames, pre-assembled in the welding plant, to the machine assembling plant.

SUMMARY OF THE INVENTION

In view of the foregoing, it is an object of the present invention to provide a machine frame of a multi-head sewing machine which can be transported efficiently and can be assembled, after the transport, with simple operations, as well as a method for assembling the sewing machine frame.

The present invention provides a sewing machine frame, which comprises: a main frame including an upper support member for supporting thereon a plurality of machine heads in a substantially horizontal orientation and in side-by-side or juxtaposed relation to each other and a lower support member for supporting thereon a plurality of hook bases in a substantially horizontal orientation and in side-by-side or juxtaposed relation to each other, the upper support member and the lower support member being positioned in substantially parallel relation to each other with a predetermined interval therebetween and integrally joined with each other via a joint member; and a supporting leg section provided separately from the main frame, the supporting leg section being attached to a predetermined position of the main frame to support the main frame in a substantially horizontal orientation at a predetermined height.

According to the sewing machine frame construction of the present invention, the integrally-constructed main frame, including the upper support member and lower support member, and the supporting leg section, are provided as separate component parts, and the sewing machine frame is constructed by assembling or attaching the supporting leg section to the main frame. Because the main frame is constructed of the upper and lower support members integrally joined via the joint member, the main frame and the supporting leg section can be transported to a predetermined assembling place before the supporting leg section is assembled or attached to the main frame. Thus, the main frame and the supporting leg section can be transported efficiently at low cost. With the main frame and the supporting leg section transported in a mutually-separated state, the main frame and the supporting leg section can be packed into small-bulk (i.e., small-size or small-volume) packages, so that the invention allows the main frame and supporting leg section to be transported with ease and also permits efficient use of a storage space at the time of transport of the two component parts. For example, in cases where a plurality of the main frames of the same shape and the same type and a plurality of the supporting leg sections of the same shape and the same type are packed at the same time, the present invention can reduce the overall package size or volume as compared to the conventional technique where completed machine frames have to be packed as they are. In addition, the present invention allows a greater number of the main frames and supporting leg sections to be loaded into a limited storage space for transportation. Thus, for the same number of the sewing machine frames, the present invention allows these sewing machine frames to be transported in smaller-bulk packages than the conventional technique. Further, the present invention allows each sewing machine frame to be assembled by just attaching the main frame to the supporting leg section as noted earlier; thus, each sewing machine frame can be assembled with ease even in a transported-to place. Furthermore, because the upper support member for supporting thereon a plurality of machine heads in a substantially horizontal orientation and in juxtaposed (i.e., side-by-side) relation to each other and the lower support member for supporting thereon a plurality of hook bases in a substantially horizontal orientation and in juxtaposed relation to each other are integrally joined together in a predetermined positional relation to each other, predetermined positional relationship between the machine heads and the hook bases is secured in advance. As a result, each sewing machine frame can be assembled with utmost ease without a human operator having to care about the positional relationship between the machine heads and the hook bases in the transported-to place.

The present invention also provides a method for assembling a sewing machine frame, which comprises: a step of providing a main frame including an upper support member for supporting thereon a plurality of machine heads in a substantially horizontal orientation and in juxtaposed relation to each other and a lower support member for supporting thereon a plurality of hook bases in a substantially horizontal orientation and in juxtaposed relation to each other, the upper support member and the lower support member being positioned in substantially parallel relation to each other with a predetermined interval therebetween and integrally joined with each other via a joint member; a step of providing a supporting leg section for being attached to a predetermined position of the main frame to support the main frame in a substantially horizontal orientation at a predetermined height; a step of transporting each of the provided main frame and supporting leg section to an assembling place; and a step of completing the sewing machine frame by attaching the supporting leg section to the transported main frame in the assembling place. With the method thus arranged, the main frame, comprising the upper support member and lower support member integrally joined with each other via the joint member, is provided separately from the supporting leg section, and the main frame and the supporting leg section can be transported to a predetermined assembling place before the supporting leg section is assembled to the main frame. Then, the sewing machine frame is completed by attaching the supporting leg section to the transported main frame in the assembling place. Thus, an efficient and low-cost transport is permitted, similarly to the above-mentioned.

According to another aspect of the present invention, there is provided a method for assembling a sewing machine frame, which comprises a step of providing a main frame including an upper support member for supporting thereon a plurality of machine heads in a substantially horizontal orientation and in juxtaposed relation to each other and a lower support member for supporting thereon a plurality of hook bases in a substantially horizontal orientation and in juxtaposed relation to each other, the upper support member and the lower support member being positioned in substantially parallel relation to each other with a predetermined interval therebetween and integrally joined with each other via a joint member, the step of providing including providing the lower support member with a base for mounting thereon the hook bases; a step of providing a supporting leg section for being attached to a predetermined position of the main frame to support the main frame in a substantially horizontal orientation at a predetermined height; a step of transporting each of the provided main frame and supporting leg section to an assembling place; and a step of completing the sewing machine frame by assembling the supporting leg section to the transported main frame in the assembling place. With the method thus arranged, the lower support member of the provided main frame is equipped with the base for mounting thereon the hook bases. Thus, an operation for attaching the hook bases to the main frame at a subsequent step can be performed with ease.

According to still another aspect of the present invention, there is provided a method for assembling a sewing machine frame, which comprises: a step of providing a main frame including an upper support member for supporting thereon a plurality of machine heads in a substantially horizontal orientation and in juxtaposed relation to each other and a lower support member for supporting thereon a plurality of hook bases in a substantially horizontal orientation and in juxtaposed relation to each other, the upper support member and the lower support member being positioned in substantially parallel relation to each other with a predetermined interval therebetween and integrally joined with each other via a joint member; a step of providing a supporting leg section for being attached to a predetermined position of the main frame to support the main frame in a substantially horizontal orientation at a predetermined height; a step of attaching, to the provided main frame, component parts including the machine heads and hook bases; a step of transporting, to an assembling place, the main frame having the component parts attached thereto and the provided supporting leg section; and a step of completing the sewing machine frame by attaching the supporting leg section to the transported main frame in the assembling place. With the method thus arranged, the main frame, comprising the upper support member and lower support member integrally joined with each other via the joint member, is provided separately from the supporting leg section, and the main frame and the supporting leg section can be transported to a predetermined assembling place before the supporting leg section is assembled to the main frame. Then, the sewing machine frame is completed by attaching the supporting leg section to the transported main frame in the assembling place. Thus, an efficient and low-cost transport is permitted, similarly to the above-mentioned.

Namely, according to the present invention, where the integrally-constructed main frame, including the upper support member and lower support member, and the supporting leg section, are provided as separate component parts, and the sewing machine frame is constructed by attaching the supporting leg section to the main frame, the main frame and supporting leg section of each sewing machine frame can be transported separately in small-bulk (i.e., small-size or small-volume) packages, which can thereby advantageously enhance the transport efficiency. Particularly, in cases where sewing machine frames are transported to or from abroad by ship, air or otherwise, the transport cost reduction effect, achievable by the present invention capable of packing the machine frames and supporting leg sections in small-bulk packages, will become prominent.

Further, in order to assemble each sewing machine frame after the transport, it is only necessary to attach together the main frame and the supporting leg section; thus, the sewing machine frame can be completed with utmost ease even in a transported-to place.

BEST MODE FOR CARRYING OUT THE INVENTION

Embodiments of the present invention will hereinafter be described with reference to the accompanying drawings.

Figure 1:
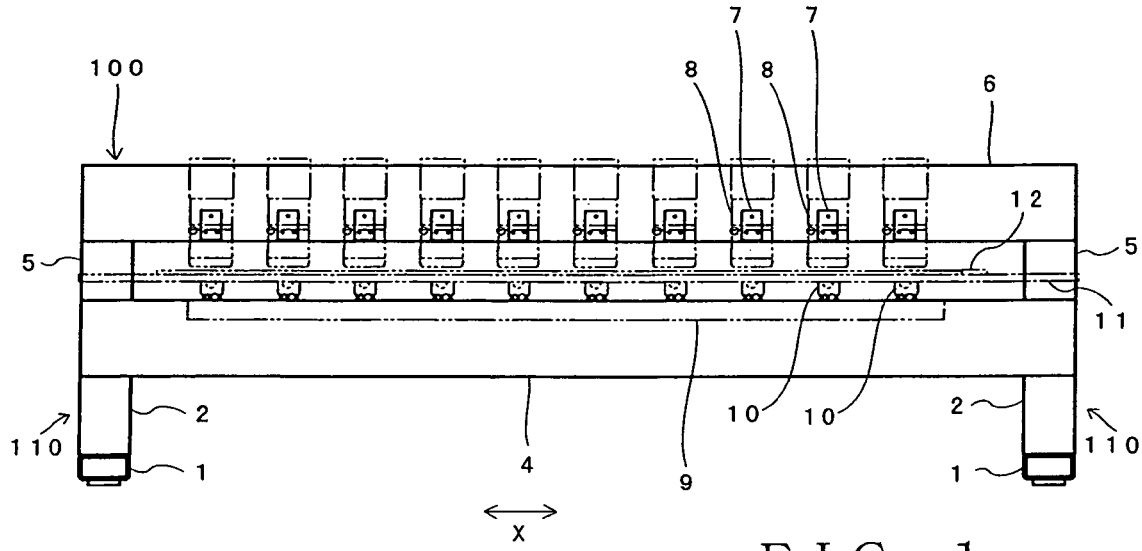
FIG. 1 is a front view showing a first embodiment of a sewing machine frame-according to the present invention.
Figure 2:
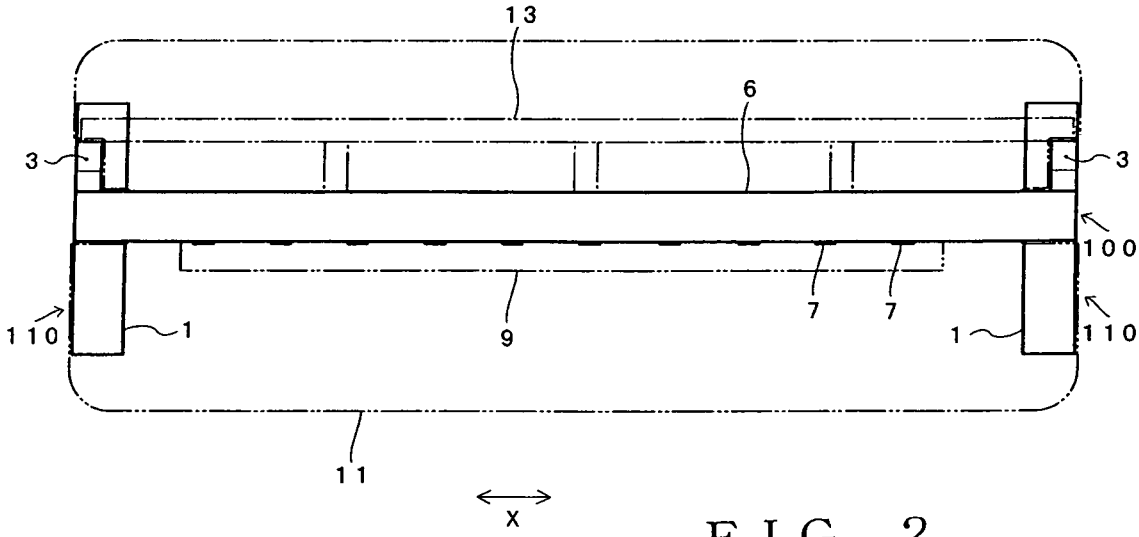
FIG. 2 is a plan view of the first embodiment of the sewing machine frame.
Figure 3:
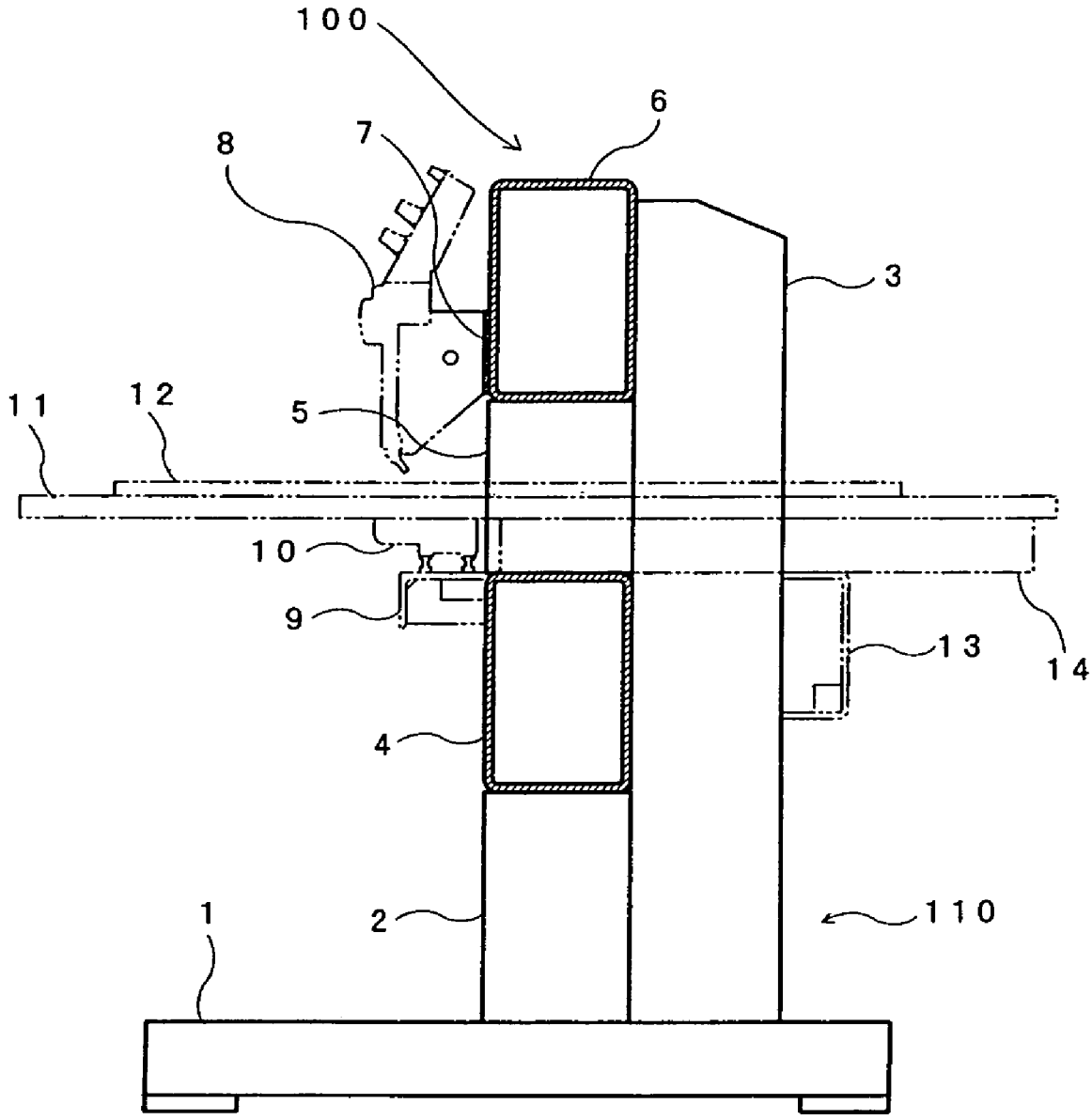
FIG. 3 is a side view of the first embodiment of the sewing machine frame.
Figure 4:
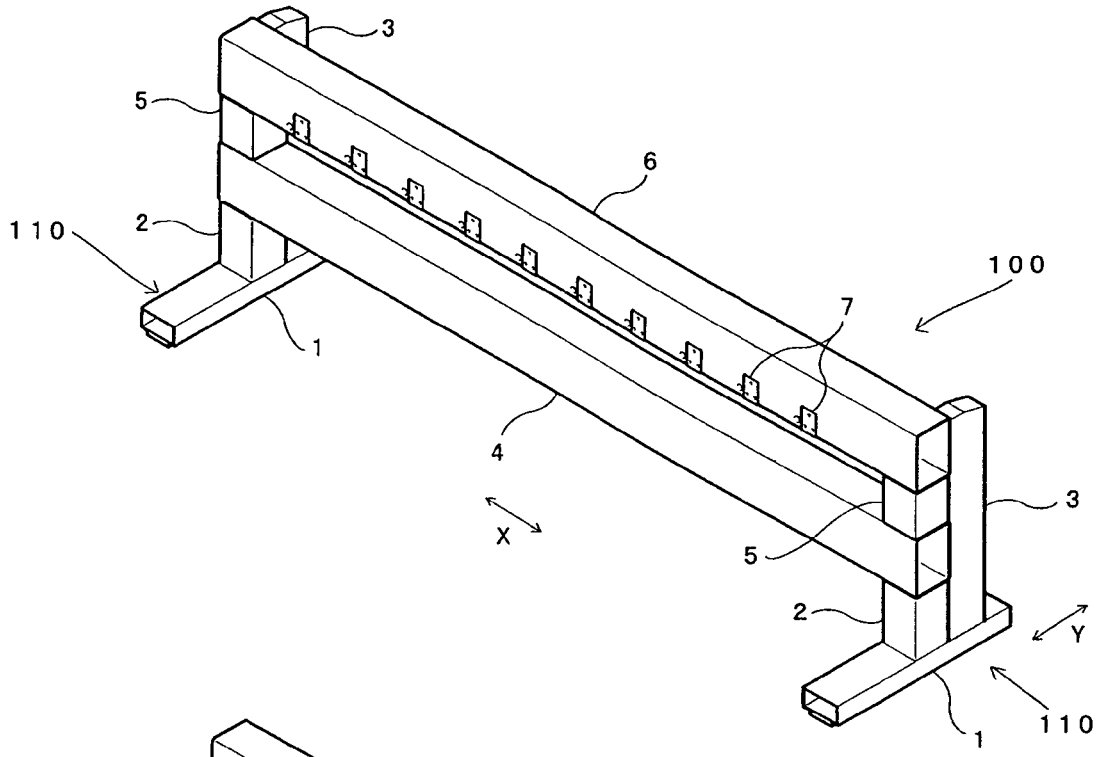
FIG. 4 is a perspective view of the first embodiment of the sewing machine frame.

First of all, a description will be given about a first embodiment of a sewing machine frame in accordance with the present invention, with reference to FIGS. 1-5. FIG. 1 is a front view of the first embodiment of the sewing machine frame, FIG. 2 is a plan view of the sewing machine frame, FIG. 3 is a side view of the sewing machine frame, and FIG. 4 is a perspective view of the sewing machine frame. In FIGS. 1-3, the body of the sewing machine frame is indicated by solid lines, while component parts added to the sewing machine frame to complete a multi-head sewing machine as a final product, i.e. other component parts of the multi-head sewing machine than the sewing machine frame, are indicated by phantom lines.

As seen in the figures, the first embodiment of the sewing machine frame generally comprises a main frame 100 composed of a lower support member (also referred to as a lower frame) 4, an upper support member (also referred to as an upper frame) 6 and supporting posts 5, and a pair of left and right supporting leg sections 110 each including a base 1, supporting post 2 and auxiliary supporting post 5. The individual component parts of the main frame 100, i.e. the lower support member 4, upper support member 6 and supporting posts 5 are each formed of a high-rigidity material having a rectangular sectional shape, such as a rectangular steel pipe. Needless to say, the base 1, supporting post 2 and auxiliary supporting post 5 of each of the supporting leg sections 110 are each formed of a high-rigidity material, such as a rectangular steel pipe.

The lower support member 4, upper support member 6 and supporting posts 5 of the main frame 100 are assembled together as an integral unit, by positioning the support members 4 and 6, each formed for example of a rectangular steel pipe, in parallel relation to each other with a predetermined interval (specifically, spacing corresponding to a height of the supporting posts 5) therebetween and welding the supporting posts 5 as joint members between the lower and upper support members 4 and 6 at opposite ends in a left-and-right direction (i.e., direction of arrow X in the figure) of the support members 4 and 6. Namely, the upper support member 6, formed of a rectangular steel pipe similarly to the lower support member 4, is fixed, via the supporting posts 5, to the lower support member 4 in parallel relation thereto. In each of the supporting leg sections 110, the supporting post 2 and auxiliary supporting post 3 are welded to the base 1 in such a manner that they extend vertically upward from the base 1; thus, the base 1, supporting post 2 and auxiliary supporting post 3 are assembled together as an integral unit. Namely, each of the supporting leg sections 110 is constructed by weld-fixing the supporting post 2, formed of a rectangular steel pipe, to a substantial center portion of the base 1 that is formed of a rectangular steel pipe similarly to the supporting post 2 and has a predetermined length in a front-and-rear direction (direction of arrow Y in the figure), then weld-fixing the auxiliary supporting post 3, also formed of a rectangular steel pipe, to the rear surface of the supporting post 2 and also weld-fixing the lower end of the auxiliary supporting post 3 to the base 1. Namely, the supporting leg section 110 comprises an integrally-assembled unit of the base 1, supporting post 2 and auxiliary supporting post 3, and the left and right supporting leg sections 110 are provided to support the left and right sides of the main frame 100 in an assembled state of the sewing machine frame.

Figure 5:
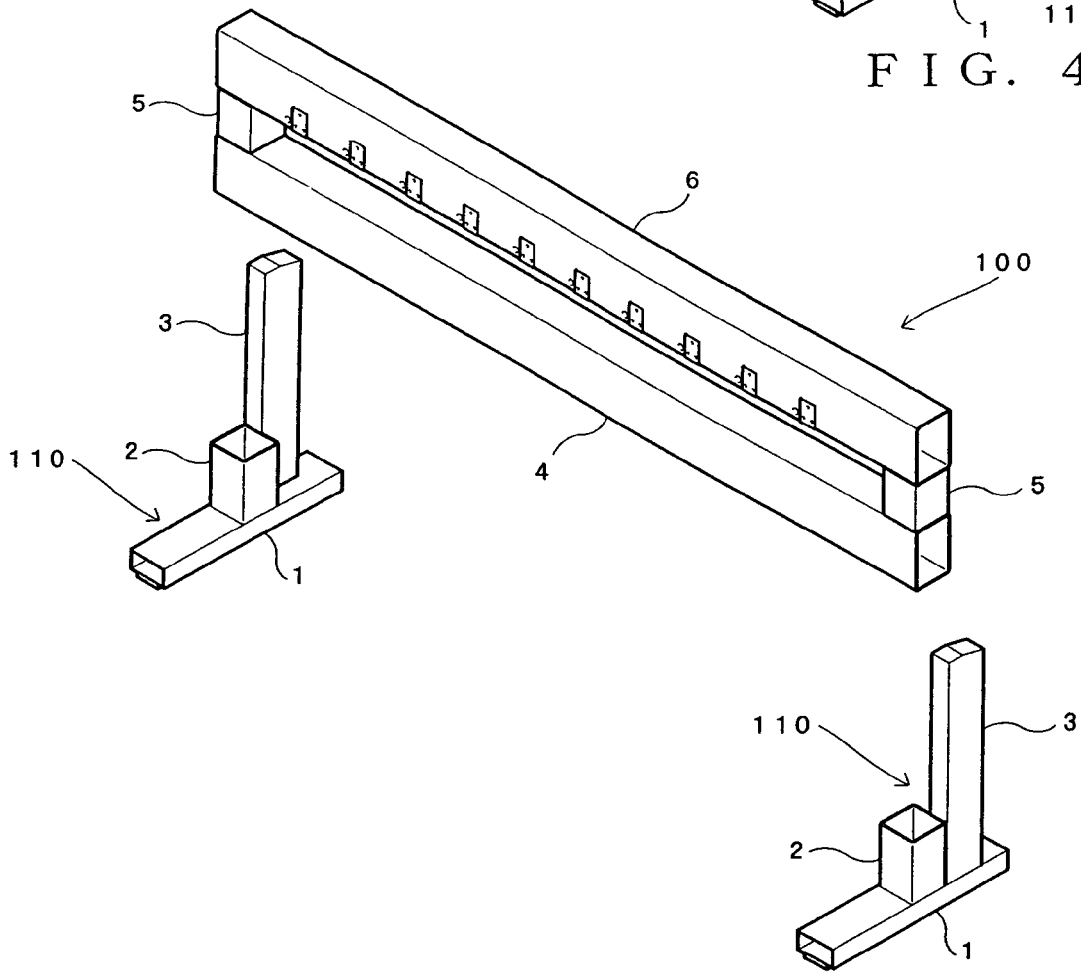
FIG. 5 is an exploded perspective view showing an assembling construction of the first embodiment of the sewing machine frame.

The aforementioned main frame 100 and supporting leg sections 110 are manufactured separately in, for example, a welding plant, and then transported to a machine assembling plant for assembling a multi-head sewing machine as a final product. In the machine assembling plant, the main frame 100 and supporting leg sections 110 are assembled ultimately into the multi-head sewing machine. Namely, the multi-head sewing machine is completed by adding other component parts of the sewing machine to the machine frame constructed of the main frame 100 and supporting leg sections 110. Now, with reference to FIG. 5, a description will be given about a method for assembling and processing the main frame 100 and supporting leg sections 110 transported to the machine assembling plant. FIG. 5 is an exploded perspective view explanatory of assembling and processing the main frame.

As illustrated in FIG. 5, the sewing machine frame is assembled by fixing the supporting leg sections 110 to the opposite end portions of the main frame 100. In this case, the lower support member 104 of the main frame 100 is welded at the lower surfaces of its opposite end portions to the respective upper ends of the supporting posts 2. Namely, the main frame 100 and supporting leg sections 110 are welded together with the lower support member 104 and upper support member 6 placed over and cross-bridging the supporting posts 2. Further, the front surface of the auxiliary supporting post 3 in each of the supporting leg sections 110 and the rear surface of the main frame 100 are welded together. In the sewing machine frame of the present invention, the supporting leg sections 110 must be fixed to the main frame 100 in such a manner that the respective front surfaces of the upper support member 6 and lower support member 104 lie parallel to each other and vertically to a floor surface. Because, it is preferable that the front surface of the upper support member 6, on which machine heads 8 are to be mounted, and the front surface of the lower support member 104, on which hook bases 10 are to be mounted via a machine base 9, lie accurately parallel to each other and vertically to the floor surface at the time of assembly of a multi-head sewing machine to be described below. Further, because a table 11 is mounted on the upper surface of the lower support member 4 in such a manner that its upper surface and the floor surface lie parallel to each other, and because a drive mechanism 14 for driving a holder frame 12, holding a sewing material (i.e., to-be-sewn material) such as a fabric, to move in any of the forward/rearward and leftward/rightward directions on and along the table 11 is mounted on the upper surface of the lower support member 4 along with other component parts, it is preferable that the upper surface of the lower support member 4 lie vertically to the floor surface with a high accuracy. Therefore, not only the main frame 100 is pre-assembled so that the front surface (rear surface) of the upper support member 6 and the front surface (rear surface) of the lower support member 4 lie parallel to each other, but also the front surface of the auxiliary supporting post 3 and the rear surface of the main frame 100 are arranged so that these surfaces can be welded together in close contact each other when the sewing machine frame is to be assembled. Thus, arrangements are made to allow the supporting leg sections 110 to be fixed to the main frame 100 in such a manner that the front surfaces of the upper support member 6 and lower support member 104 lie parallel to each other and vertically to the floor surface with a high accuracy.

Other component parts for constituting the sewing machine are attached to the sewing machine frame assembled in the above-described manner, to complete a multi-head sewing machine. As illustrated in FIGS. 1-3, a plurality of seat members 7 are fixedly provided on the front surface of the upper support member 6 of the main frame 100 in horizontally-spaced-apart relation to one another; in the illustrated example, ten such seat members 7 are provided and spaced apart from one another in the direction of arrow X. Each of the seat members 7 has a not-shown mounting hole, and one machine head 8 is mounted on each of the seat members 7 by means of the mounting hole. The machine base 9 is fixed to the front surface of the lower support member 4, and the hook bases 10 are disposed on the upper surface of the machine base 9 at positions corresponding to the machine heads 8. The table 11 is disposed between the upper support member 6 and the lower support member 4, and the holder frame 12, holding a sewing material such as a fabric, is placed on the upper surface of the table 11 for free movement therealong. Stay 13 is disposed behind the lower support member 4, and this stay 13 is fixed at its opposite ends to the read surface of the two auxiliary supporting post 3. Studs (not shown) supporting the table 11, drive mechanism 14 for driving the holder frame 12 etc. are mounted on the stay 13. The various component parts of the completed multi-head sewing machine are known per se, and thus, functions, behavior, etc. of these component parts will not be described here.

With the sewing machine frame comprising a combination of the above-described main frame 100 and supporting leg sections 110 set forth above, the instant embodiment of the present invention allows a plurality of sewing machine frames to be transported in smaller bulk than the conventional techniques. Namely, with the instant embodiment of the invention, it is possible to individually package a plurality of the main frames 100 each having a rectangular general shape with no particular projecting portion and a plurality of the supporting leg sections 110 each having a T shape, and the packages can each have small bulk, so that the instant embodiment of the invention permits a significant reduction of the transport cost for transporting the packaged main frames 100 and supporting leg sections 110. Further, when sewing machine frames are to be assembled after the transport, each sewing machine frame can be assembled accurately by just fixing the main frame 100 along the auxiliary supporting post 3. Thus, each sewing machine frame can be completed even in a transported-to place.

Figure 6:
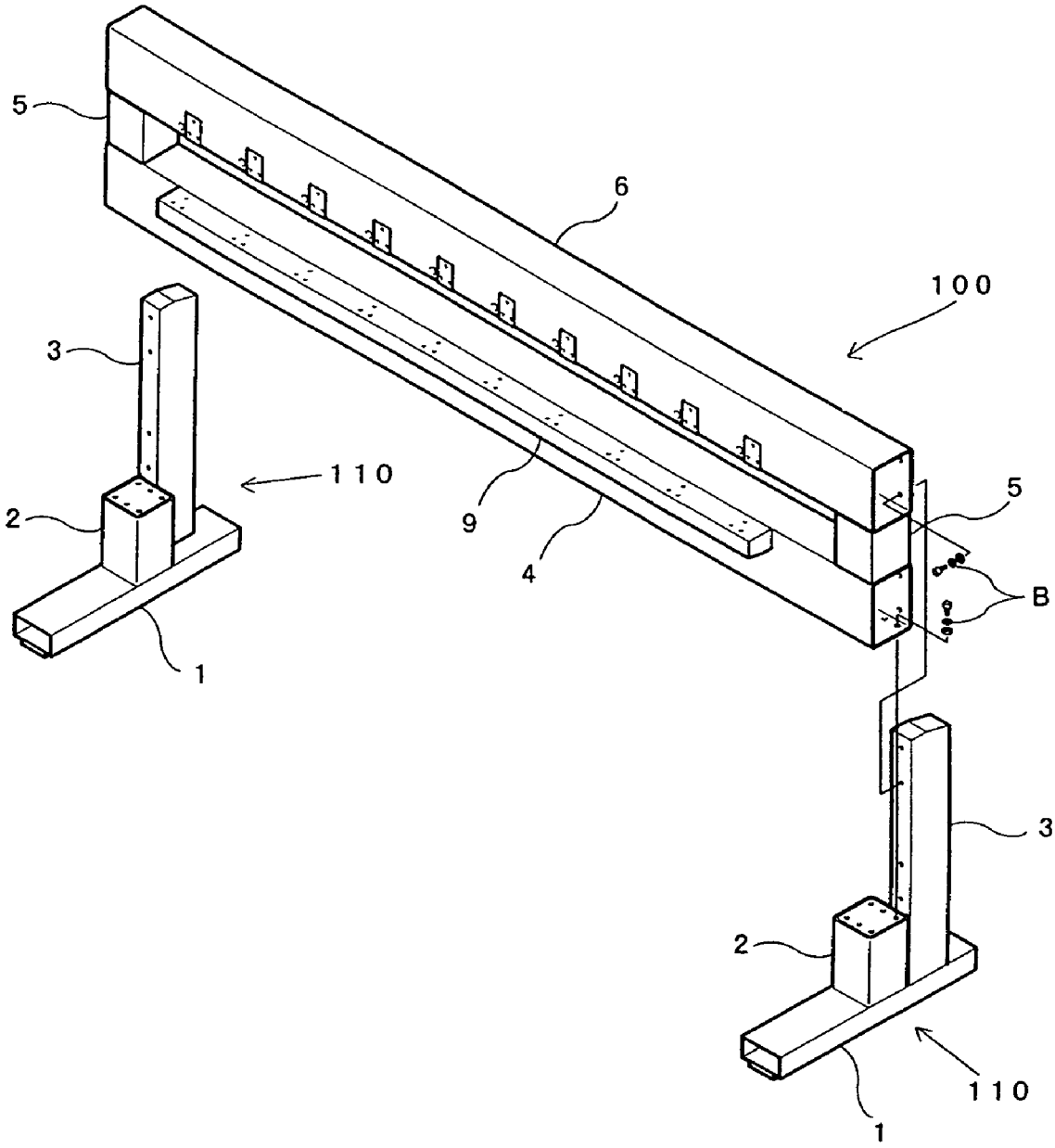
FIG. 6 is an exploded perspective view showing an assembling construction of a second embodiment of the sewing machine frame according to the present invention.

Next, a description will be made about a sewing machine frame according to a second embodiment of the present invention, with reference to FIG. 6. The sewing machine frame of FIG. 6 is different from the first embodiment in that the machine base 9 is fixedly mounted in advance to the lower support member 4 of the main frame 100. In addition to the machine base 9, any other members or component parts that will not present inconveniences in the transport and packaging operations may be fixedly mounted in advance to the lower support member 4. Whereas the main frame 100 in the first embodiment of the sewing machine frame has been described above as being welded to the supporting leg sections 110, the main frame 100 and the supporting leg sections 110 may be joined together by means of bolts B as illustrated in FIG. 6. In such a case, it is necessary that holes for inserting the bolts B be formed in predetermined positions, as shown in FIG. 6, of both of the main frame 100 and supporting leg sections 110. Thus, in this case, the main frame 100 can be readily fixed to the supporting leg sections 110 at accurate positions of the latter as compared to the case where the main frame 100 is welded to the supporting leg sections 110. Further, by fixing in advance the machine base 9 to the main frame 100, other component parts can be accurately mounted to the sewing machine frame; in particular, the look bases 10 can be accurately fixed to the machine base 9 at positions corresponding to the machine heads 8. Note that any other suitable detachable fasteners than the bolts B may be used.

Whereas the auxiliary supporting posts 3 in each of the embodiments have been described above as component parts of the supporting leg sections 110, the auxiliary supporting posts 3 may be dispensed with because they are not necessarily essential component parts of the supporting leg sections 110. However, it is more preferable to use the auxiliary supporting posts 3, in view of, for example, the advantages that, with the auxiliary supporting posts 3 reinforcing the joint between the main frame 100 and the supporting leg sections 110, vibration of the entire sewing machine occurring during operation of the sewing machine can be restrained and rigidity of the sewing machine can be retained.

Further, in each of the above-described embodiments, the seat members 7 for fixing the machine heads 8 are fixed to the front surface of the upper support member 6 after the sewing machine frame has been assembled. However, the present invention is not so limited; for example, the seat members 7 may be fixed to the front surface of the upper support member 6 in advance before the sewing machine frame (or main frame 100) is assembled.

Furthermore, whereas each of the above-described embodiments has been described above as completely assembling the sewing machine frame by attaching the supporting leg sections 110 to the main frame 100 in a machine assembling plant, the present invention is not so limited. For example, various component parts or members, such as the machine heads 8, hook bases 10 and table 11, may be merely attached to the transported main frame 100 in the machine assembling plant, and then the main frame 100 having these various component parts or members attached thereto and the supporting leg sections 110 may be transported, in mutually-separated form, from the machine assembling plant to a user's place. In this case, the transported supporting leg sections 110 are attached to the transported main frame 100, in the user's place, to complete the sewing machine frame, i.e. multi-head sewing frame as a final product. In this way, the present invention can enhance the transporting efficiency in transporting the main frames 100 and supporting leg sections 110 to the user's place and can also reduce the transporting cost.

Figure 7:
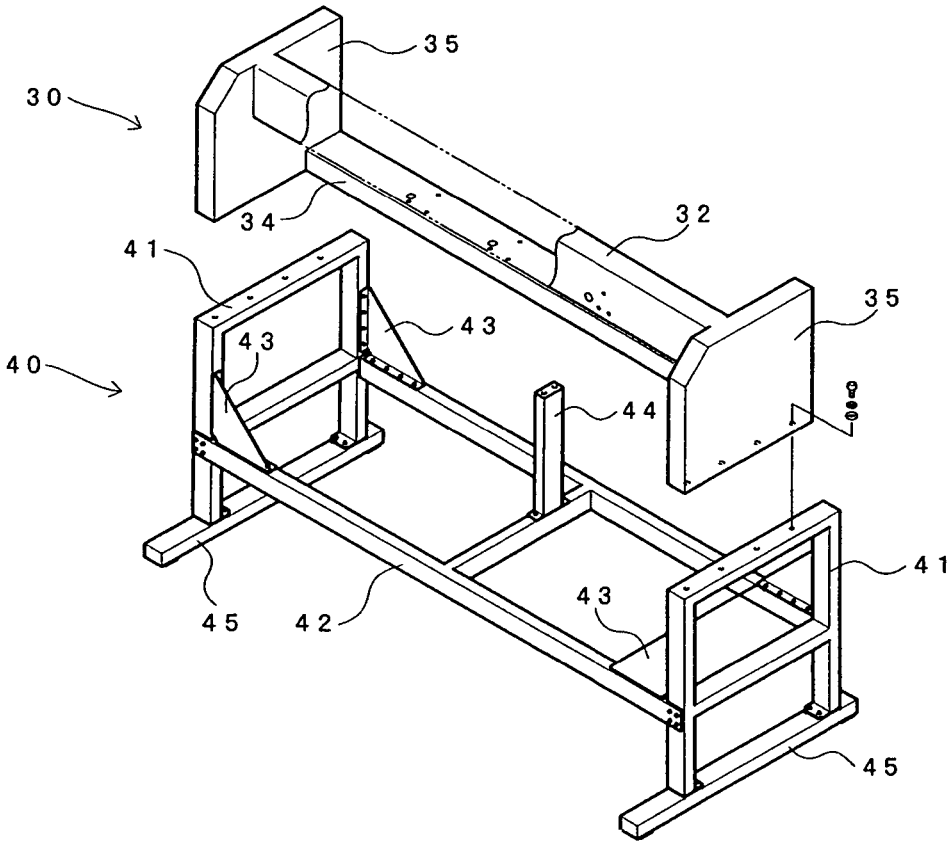
FIG. 7 is an exploded perspective view showing an assembling construction of a third embodiment of the sewing machine frame according to the present invention.
Figure 8:
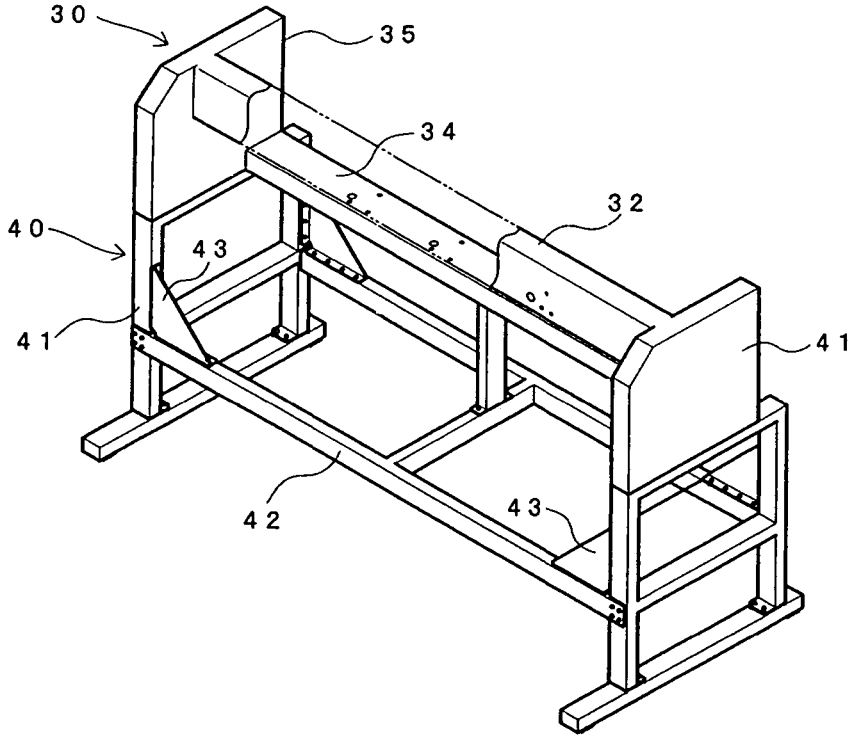
FIG. 8 is a perspective view of the third embodiment of the sewing machine frame in an assembled state.
Figure 9:
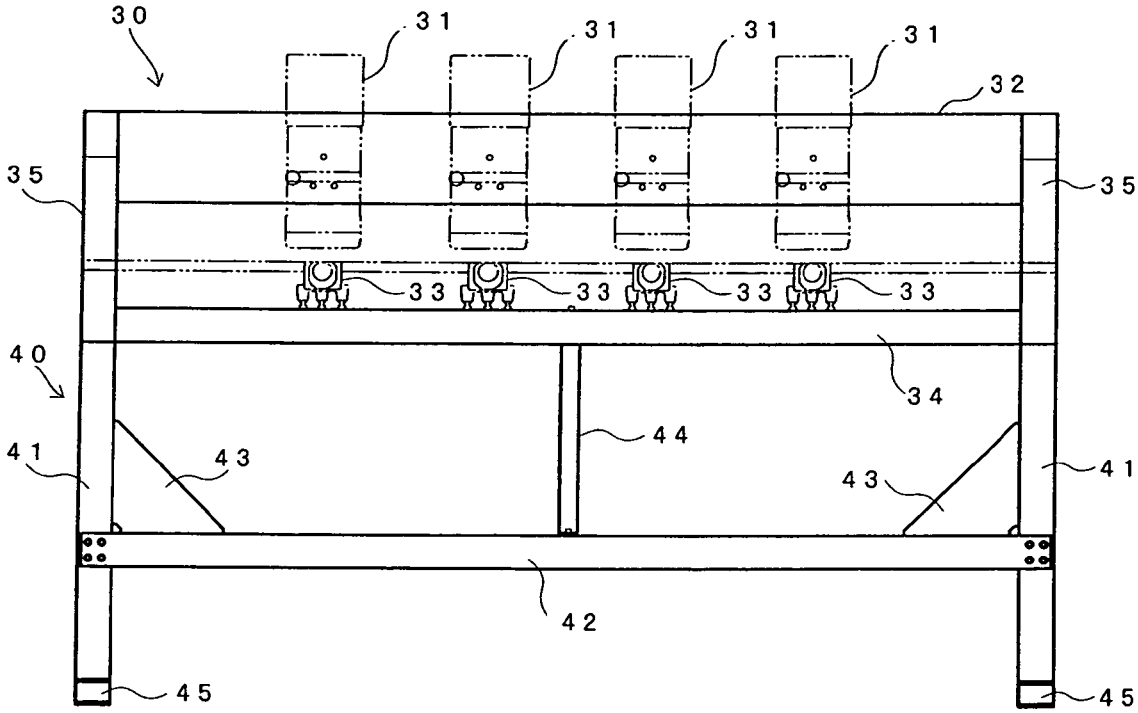
FIG. 9 is a front view of the third embodiment of the sewing machine frame in an assembled state.
Figure 10:
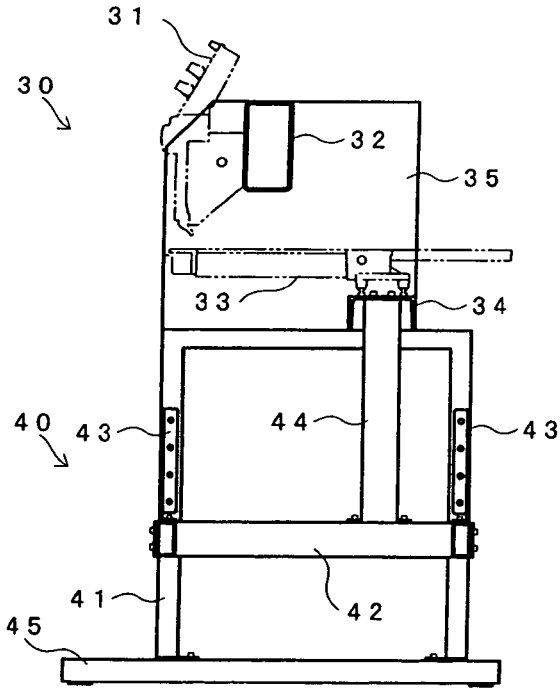
FIG. 10 is a vertical sectional view of the third embodiment of the sewing machine frame in an assembled state.

Next, a description will be made about a sewing machine frame according to a third embodiment of the present invention, with reference to FIGS. 7-11. The sewing machine frame shown in FIGS. 7-11 is a machine frame of an embroidery sewing machine having a relatively small number of (e.g., eight) machine heads; in these figures, there is shown a machine frame of an embroidery sewing machine capable of embroidering a cylindrical embroidering workpiece. FIG. 7 is a perspective view of the sewing machine frame with the main frame 30 and supporting leg section 40 separated from each other, and FIG. 8 is a perspective view of the sewing machine frame with the supporting leg section 40 assembled or attached to the main frame 30. In both FIG. 7 and FIG. 8, the upper support member 32 of the main frame 30 is partly broken away, as indicated by phantom lines, to make the lower support member 34 more easily visible. FIGS. 9 and 10 are a front view and vertical sectional view of the sewing machine frame, which particularly shows the supporting leg section 40 attached to the main frame 30 and in which component parts added to the sewing machine frame to complete a multi-head sewing machine as a final product, i.e. other component parts of the multi-head sewing machine than the sewing machine frame, are indicated by phantom lines and the body of the sewing machine frame is indicated by solid lines.

In the sewing machine frame according to the third embodiment, as illustrated in the figures, the upper support member 32 for supporting the machine heads 31 and the lower support member 34 for supporting the hook bases (cylinder heads) 33 are joined with each other via a pair of left and right boxes (joint members) 35, to thereby form the main frame 30. The supporting leg section 40 detachably attached to the main frame 30 via fastener means, such as bolts and nuts, includes a pair of left and right stands (leg members) 41, cross connection member (structural member) 42 connecting between the stands 41, reinforcing member (structural member) 43 for reinforcing the fixation between the stands 41 and the cross connection member 42, supporting post 44 for supporting a substantial middle portion of the lower support member 34, and a pair of leg base members 45. These component parts are detachably fixed together via detachable fasteners, such as bolts or screws.

When the machine frame is to be transported from the welding plant to the machine assembling plant, the main frame 30, having the upper and lower support members 32 and 34 integrally welded to the left and right boxes 35, and the various component parts of the supporting leg section 40 are transported in mutually-separated form. In the machine assembling plant, the supporting leg section 40 is first assembled. Namely, the various component parts of the supporting leg section 40, such as the left and right stands 41, cross connection member 42, reinforcing member 43, supporting post 44 and leg base members 45, are assembled and fixed together via detachable fasteners, such as bolts or screws. Then, the main frame 30 is placed on the supporting leg section 40 and the main frame 30 and supporting leg section 40 are assembled together via detachable fasteners, such as bolts and screws, to thereby assemble a finished machine frame. Then, various other component parts constituting the sewing machine, such as the machine heads 31 and cylinder heads 33, are attached to the thus-assembled machine frame. In an alternative, the various component parts of the supporting leg section 40 may be assembled together in the welding plant, and the thus-completed supporting leg section 40 may be transported from the welding plant to the machine assembling plant. In such a case, the various component parts of the supporting leg section 40 may be fixed together by welding, rather than via detachable fasteners such as bolts and screws. However, an enhanced transporting efficiency can be achieved by transporting the various component parts of the supporting leg section 40 from the welding plant to the machine assembling plant in mutually-separated form.

As set forth above, when the machine frame is to be transported from the machine frame from the welding plant to the machine assembling plant, the third embodiment too transports the main frame 30 and the supporting leg section 40 separately, thereby reducing the overall size of packages and achieving an enhanced transporting efficiency and reduced cost. Further, by transporting the various component parts of the supporting leg section 40 in mutually-separated form, the third embodiment can achieve an even further enhanced transporting efficiency and even further reduced cost.

Figure 11:
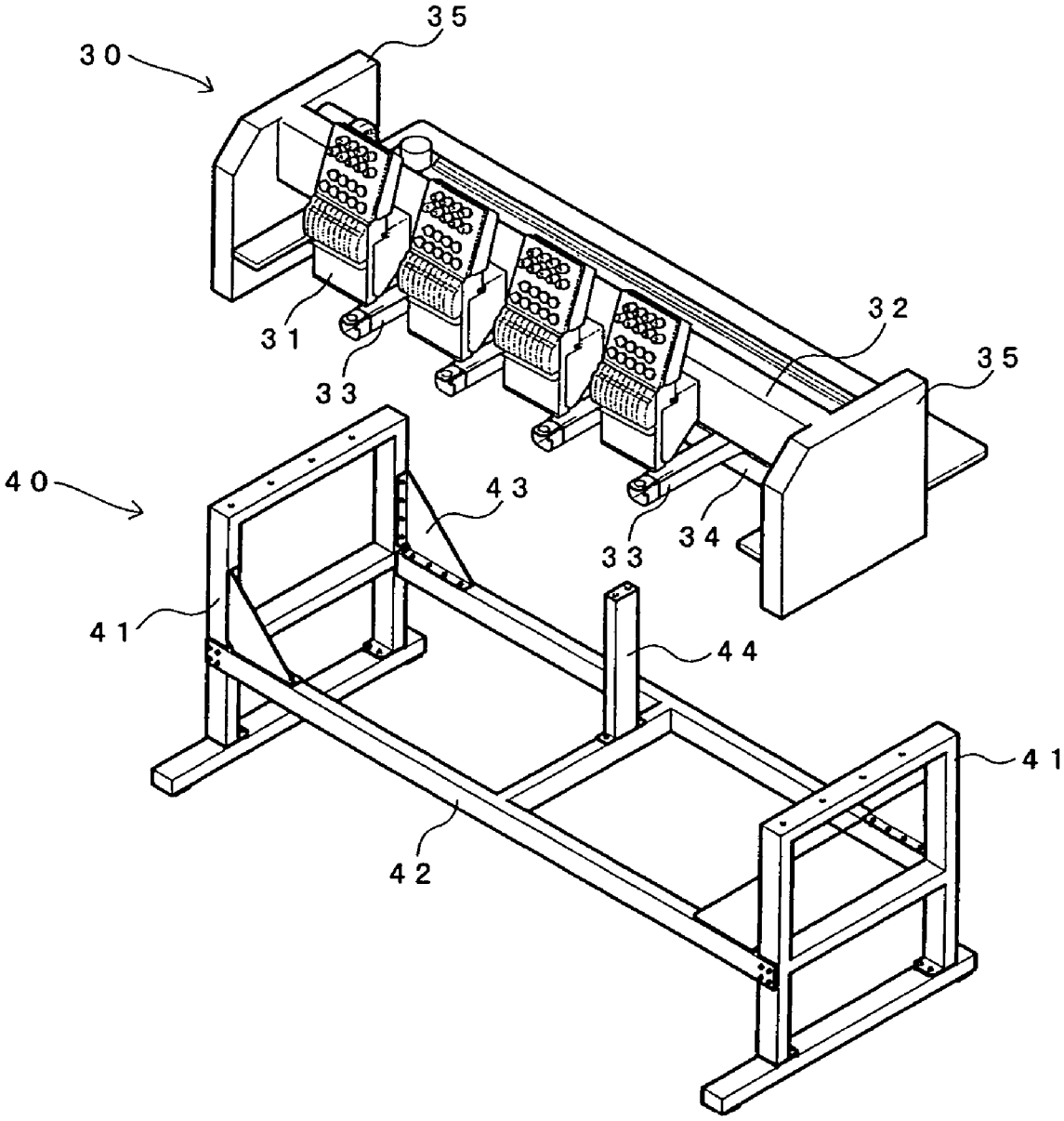
FIG. 11 is an exploded perspective view showing how a supporting leg section is attached to a main frame in the third embodiment of the sewing machine frame after component parts have been attached to the main frame.
Figure 12:
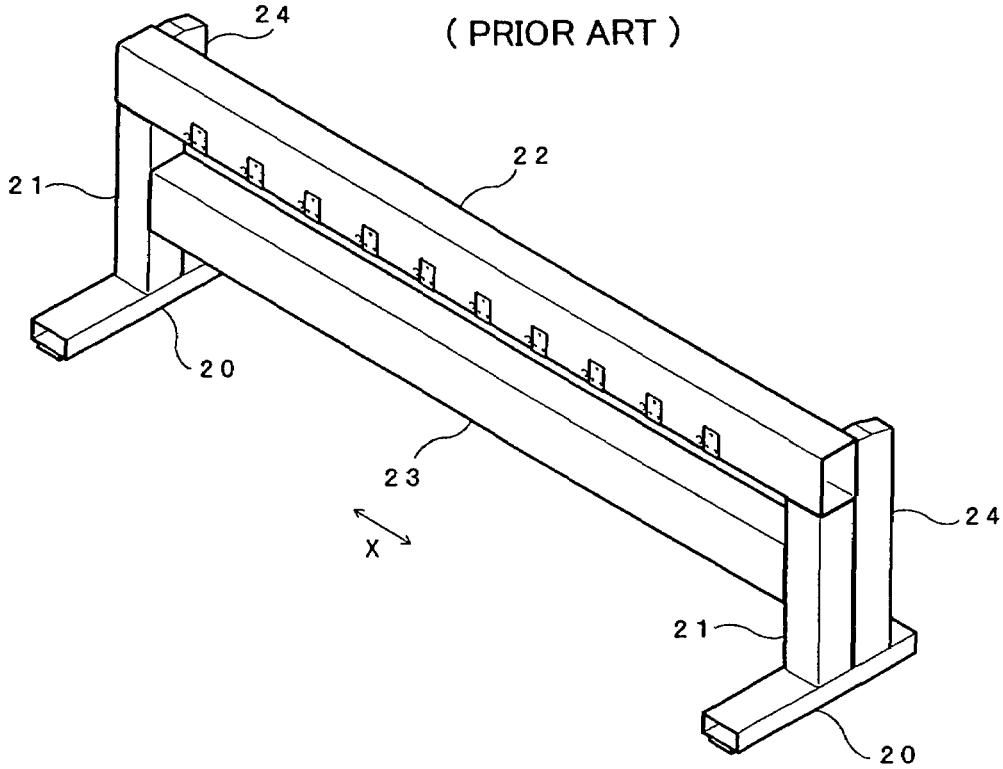
FIG. 12 is a perspective view of a conventional sewing machine frame.
Figure 13:
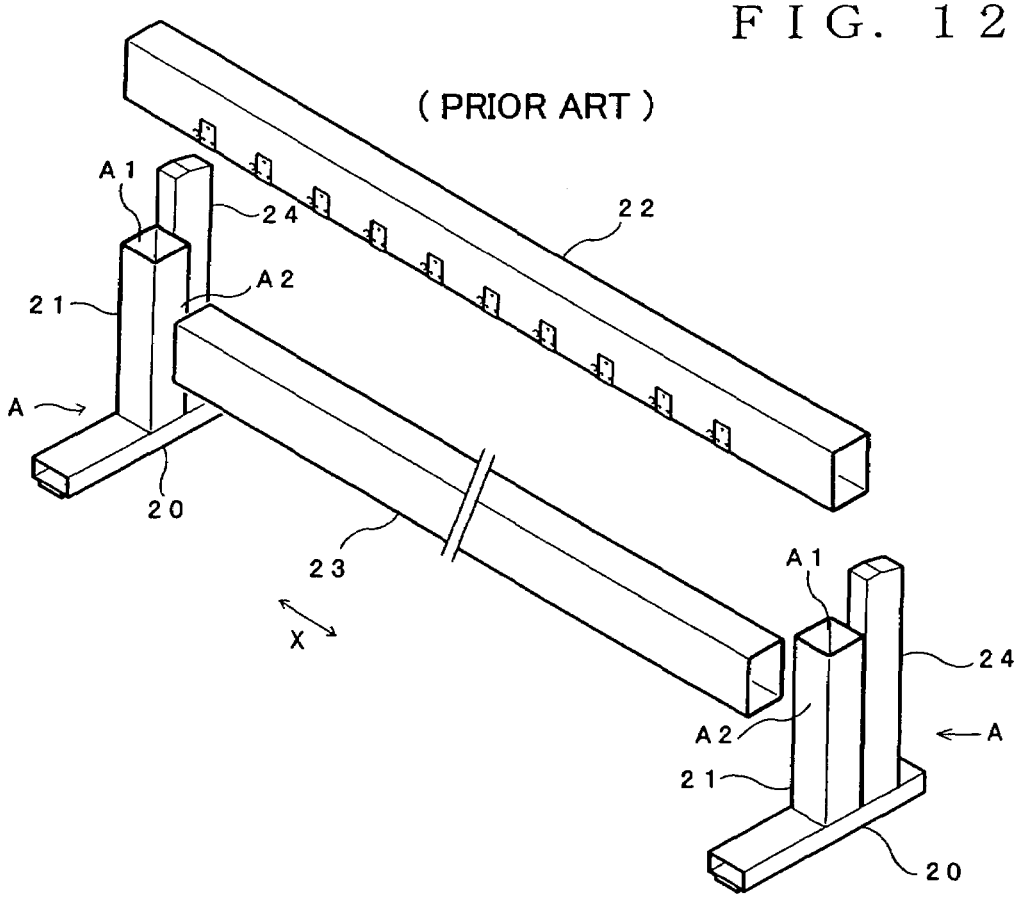
FIG. 13 is an exploded perspective view showing a manner in which the conventional sewing machine frame is assembled.

In the third embodiment too, various component parts and members, such as the machine heads 31, cylinder heads 33 and table, may be attached to the transported main frame 30 in the machine assembling plant, and then, the main frame 30, having the various component parts and members attached thereto, and the supporting leg section 40 may be transported from the machine assembling plant to the place of the user in mutually-separated form. FIG. 11 is a perspective view showing the main frame 30, having the various component parts and members, such as the machine head 31, cylinder head 33 and table, attached thereto and the supporting leg section 40 in a mutually-separated state. In this case, the transported supporting leg section 40 is attached, in the place of the user, to the transported main frame 30 having the various component parts and members attached thereto, to thereby complete the machine frame, namely, a final multi-head sewing machine product. In this way, the third embodiment can enhance the transporting efficiency and reduce the transporting cost pertaining to the transportation from the machine assembling plant to the place of the user. Further, by transporting the various component parts of the supporting leg section 40 in mutually-separated form, the third embodiment can achieve an even further enhanced transporting efficiency and even further reduced cost, in a similar manner to the aforementioned.

What is claimed is:

1. A sewing machine frame comprising:

a main frame including:

an upper support member for supporting thereon a plurality of machine heads in a substantially horizontal orientation and in juxtaposed relation to each other, the upper support member having mounting holes formed in predetermined positions thereof for mounting individual ones of the machine heads;

a lower support member for supporting thereon a plurality of hook bases, corresponding to the machine heads, in a substantially horizontal orientation and in juxtaposed relation to each other, the lower support member having substantially the same length as the upper support member; and a pair of joint members positioned between respective opposite ends of the upper support member and the lower support member so that said upper support member and said lower support member are positioned in substantially parallel relation to each other with a predetermined interval therebetween, wherein the joint members are welded to said upper support member and said lower support member; and a pair of mutually-separated supporting leg sections for attached to left and right ends, respectively, of said main frame to support said main frame in a substantially horizontal orientation at a predetermined height.

2. A sewing machine frame as claimed in claim 1 further comprising a structural member for connecting between the supporting leg sections to reinforce the supporting leg sections.

3. A sewing machine frame as claimed in claim 1 wherein a base for installing the hook bases corresponding to the machine heads is fixed to a front surface of the lower support member in the main frame.

4. A sewing machine frame as claimed in claim 1 wherein each of the supporting leg sections includes a first section for supporting an underside of the main frame, and a second section for supporting a vertical section of the main frame.

5. A sewing machine frame as claimed in claim 2 wherein said structural member is detachably assembled to the supporting leg sections by means of detachable fasteners.

6. A sewing machine frame as claimed in claim 1 wherein each of said supporting leg sections are welded to said main frame.

7. A sewing machine frame as claimed in claim 1 wherein each of said supporting leg sections is detachably attached to said main frame by means of a detachable fastener.

8. A sewing machine frame as claimed in claim 7 wherein said detachable fastener is a bolt.

9. A method for assembling a sewing machine frame, said method comprising:

providing a main frame including:

an upper support member for supporting thereon a plurality of machine heads in a substantially horizontal orientation and in juxtaposed relation to each other, the upper support member having mounting holes formed in predetermined positions thereof for mounting individual ones of the machine heads;

a lower support member for supporting thereon a plurality of hook bases, corresponding to the machine heads, in a substantially horizontal orientation and in juxtaposed relation to each other, the lower support member having substantially the same length as the upper support member; and a pair of joint members positioned between respective opposite ends of the upper support member and the lower support member so that said upper support member and said lower support member are positioned in substantially parallel relation to each other with a predetermined interval therebetween, wherein said joint members are welded to said upper support member and said lower support member;

providing a pair of mutually-separated supporting leg sections and attaching said pair of mutually-separated supporting leg sections to left and right ends, respectively, of said main frame to support said main frame in a substantially horizontal orientation at a predetermined height;

transporting the provided main frame and supporting leg sections to an assembling place; and completing said sewing machine frame by assembling said supporting leg sections to the transported main frame in the assembling place.

10. A method as claimed in claim 9 further comprising providing a structural member for connecting between the leg sections to reinforce the leg sections, and wherein said transporting includes transporting said supporting leg sections and the structural member to the assembling place in a separated state, and said completing includes completing said sewing machine frame by assembling the structural member to said supporting leg sections in the assembling place and attaching the assembled supporting leg sections and the structural member to the transported main frame.

11. A method as claimed in claim 9 wherein said sewing machine frame is completed by assembling each of the supporting leg sections to the transported main frame by means of a bolt or other detachable fastener.

12. A method as claimed in claim 9 wherein each of the supporting leg sections includes a first section for supporting an underside of the main frame, and a second section for supporting a vertical section of the main frame.

13. A method for assembling a sewing machine frame, said method comprising:

providing a main frame including:

an upper support member for supporting thereon a plurality of machine heads in a substantially horizontal orientation and in juxtaposed relation to each other, the upper support member having mounting holes formed in predetermined positions thereof for mounting individual ones of the machine heads;

a lower support member for supporting thereon a plurality of hook bases, corresponding to the machine heads, in a substantially horizontal orientation and in juxtaposed relation to each other, the lower support member having substantially the same length as the upper support member; and a pair of joint members positioned between respective opposite ends of the upper support member and the lower support member so that said upper support member and said lower support member are positioned in substantially parallel relation to each other with a predetermined interval therebetween, wherein the joint members are welded to the upper support member and the lower support member, said providing a main frame further including mounting a base for mounting thereon the hook bases to the lower support member;

providing a pair of mutually-separated supporting leg sections for being attached to left and right ends, respectively, of said main frame to support said main frame in a substantially horizontal orientation at a predetermined height;

transporting the provided main frame and supporting leg sections to an assembling place; and completing said sewing machine frame by assembling said supporting leg sections to the transported main frame in the assembling place.

14. A method as claimed in claim 13 wherein said sewing machine frame is completed by assembling each of the supporting leg sections to the transported main frame by means of a bolt or other detachable fastener.

15. A method for assembling a sewing machine frame, said method comprising:

providing a main frame including:

an upper support member for supporting thereon a plurality of machine heads in a substantially horizontal orientation and in juxtaposed relation to each other, the upper support member having mounting holes formed in predetermined positions thereof for mounting individual ones of the machine heads;

a lower support member for supporting thereon a plurality of hook bases, corresponding to the machine heads, in a substantially horizontal orientation and in juxtaposed relation to each other, the lower support member having substantially the same length as the upper support member; and a pair of joint members positioned between respective opposite ends of the upper support member and the lower support member so that said upper support member and said lower support member are positioned in substantially parallel relation to each other with a predetermined interval therebetween, wherein the joint members are welded to the upper support member and the lower support member;

providing a pair of mutually-separated supporting leg sections for being attached to left and right ends, respectively, of said main frame to support said main frame in a substantially horizontal orientation at a predetermined height;

attaching, to the provided main frame, component parts including the machine heads and hook bases;

transporting, to an assembling place, said main frame having the component parts attached thereto and the provided supporting leg sections; and completing said sewing machine frame by attaching said supporting leg sections to the transported main frame in the assembling place.

16. A method as claimed in claim 15 wherein said sewing machine frame is completed by assembling each of the supporting leg sections to the transported main frame by means of a bolt or other detachable fastener.

* * * * *

UNITED STATES PATENT AND TRADEMARK OFFICE

CERTIFICATE OF CORRECTION

PATENT NO. : 7,367,275 B2
APPLICATION NO. : 10/566908
DATED : May 6, 2008
INVENTOR(S) : Ikuo Tajima It is certified that error appears in the above-identified patent and that said Letters Patent is hereby corrected as shown below:

On the title page item (22) PCT Filed: The PCT filing date of August 20, 2004 as indicated is incorrect. The correct PCT filing date is:

-- August 4, 2004 --

Signed and Sealed this

Eighth Day of July, 2008

JON W. DUDAS
*Director of the United States Patent and Trademark Office*